US010791785B2

(12) United States Patent
Kuntz

(10) Patent No.: US 10,791,785 B2
(45) Date of Patent: Oct. 6, 2020

(54) INFLATABLE NECK SUPPORT FOR CONTACT SPORTS HELMETS

(71) Applicant: Carl Kuntz, Waterloo (CA)

(72) Inventor: Carl Kuntz, Waterloo (CA)

( * ) Notice: Subject to any disclaimer, the term of this patent is extended or adjusted under 35 U.S.C. 154(b) by 50 days.

(21) Appl. No.: 16/104,672

(22) Filed: Aug. 17, 2018

(65) Prior Publication Data

US 2019/0069623 A1 Mar. 7, 2019

Related U.S. Application Data

(60) Provisional application No. 62/553,180, filed on Sep. 1, 2017.

(51) Int. Cl.
*A42B 3/04* (2006.01)
*A42B 3/00* (2006.01)

(52) U.S. Cl.
CPC ..... *A42B 3/0473* (2013.01); *A42B 3/0486* (2013.01)

(58) Field of Classification Search
CPC ..... A42B 3/046; A42B 3/0486; A42B 3/0473; A42B 3/00; A42B 3/121; A42B 3/067; A42B 3/125; A42B 1/08; A42B 1/203; A42B 1/242; A42B 3/06; A42B 3/105; A42B 3/30; A42B 3/0406; A42B 3/12; A41D 13/018; A41D 13/0512; A41D 13/0153; A41D 13/00; A41D 13/015; A41D 13/0155; A41D 2600/102; A63B 71/081; A63B 71/10; A63B 2220/53; A63B 71/1291; A63B 71/12; A63B 2225/50; A63B 2243/007; A63B 2220/40; A63B 69/32

See application file for complete search history.

(56) References Cited

U.S. PATENT DOCUMENTS 3,430,979 A * 3/1969 Terry ..... B60R 21/18 280/733
4,172,455 A * 10/1979 Beaussant ..... A62B 18/04 128/201.23
4,178,016 A * 12/1979 Andres ..... B60R 21/01 102/531
4,243,248 A * 1/1981 Scholz ..... B60R 21/0132 280/735
4,274,161 A * 6/1981 Littler ..... A42B 3/0486 2/413
4,324,005 A * 4/1982 Willis ..... A42B 3/0486 2/413

(Continued)

*Primary Examiner* — Robert H Muromoto, Jr.
(74) *Attorney, Agent, or Firm* — Bereskin & Parr LLP

(57) ABSTRACT

A neck support apparatus for a contact sports helmet. The neck support apparatus may include an inflatable neck support including at least one air bladder normally in a deflated state, the inflatable neck support adapted to attach to the contact sports helmet; a first air supply; and at least one impact sensor adapted to trigger airflow from the first air supply into the at least one air bladder upon detection of an impact force exceeding a predetermined limit. The inflatable neck support is adapted to attach to a base portion of the contact sports helmet normally adjacent to a player's neck when worn, and inflate the at least one air bladder in a manner to deploy the inflatable neck support and help brace the player's neck immediately after an impact.

20 Claims, 11 Drawing Sheets

(56) References Cited

U.S. PATENT DOCUMENTS 4,637,074 A * 1/1987 Taheri ..... A41D 13/018 2/456
5,091,992 A * 3/1992 Pusic ..... A41D 13/018 2/16
5,203,427 A * 4/1993 Williams, Sr. ..... A62B 1/20 182/129
5,390,367 A * 2/1995 Rush, III ..... A41D 13/018 2/413
5,621,922 A * 4/1997 Rush, III ..... A42B 3/046 2/422
6,032,299 A * 3/2000 Welsh ..... A41D 13/018 2/456
6,052,835 A * 4/2000 O'Shea ..... A42B 3/00 2/425
6,079,056 A * 6/2000 Fogelberg ..... A41D 13/0153 2/267
6,175,967 B1 * 1/2001 Donzis ..... A41D 13/0153 2/413
6,385,781 B1 * 5/2002 Rose ..... A42B 3/00 2/421
7,603,725 B2 * 10/2009 Harris ..... A42B 3/121 2/410
8,056,391 B2 * 11/2011 Petelenz ..... A42B 3/046 73/11.01
8,191,421 B2 * 6/2012 Petelenz ..... F41H 1/02 73/11.01
8,621,672 B2 * 1/2014 Chuback ..... A41D 13/0512 2/421
8,947,195 B1 * 2/2015 Anvari ..... G05B 13/02 340/3.1
9,075,405 B1 * 7/2015 Anvari ..... G05B 13/02
9,131,741 B2 * 9/2015 Maliszewski ..... A42B 3/046
9,596,901 B1 * 3/2017 Anvari ..... A42B 3/046
9,603,404 B2 * 3/2017 Pocatko ..... A42B 3/0473
9,648,914 B2 * 5/2017 Duncan ..... A41D 13/018
9,648,920 B1 * 5/2017 Kuntz ..... A42B 3/20
9,788,588 B2 * 10/2017 Allen ..... A41D 13/018
9,986,777 B2 * 6/2018 Morgan ..... A42B 1/046
10,123,582 B2 * 11/2018 Crossman ..... A42B 3/046
10,165,806 B2 * 1/2019 Duncan ..... A41D 13/018
10,238,950 B2 * 3/2019 Kuntz ..... A42B 3/067
2005/0266967 A1 * 12/2005 Considine ..... A63B 69/20 482/84
2006/0073749 A1 * 4/2006 Turner ..... B63C 9/087 441/103
2012/0140676 A1 * 6/2012 Kim ..... H04M 1/7253 370/254
2014/0370806 A1 * 12/2014 Atkinson ..... G06K 19/0717 455/41.1
2015/0040685 A1 * 2/2015 Nicholson ..... A61B 5/4064 73/862.51
2017/0232327 A1 * 8/2017 Kuntz ..... A42B 3/067 2/413

* cited by examiner

INFLATABLE NECK SUPPORT FOR CONTACT SPORTS HELMETS

FIELD

The present invention relates generally to contact sports helmets, and more particularly to improvements in neck supports for contact sports helmets.

BACKGROUND

Contact sports that involve high-impact hits require protective equipment to be worn by all players in order to minimize the risk of serious sports injuries. As the consequences of injuries to the head of contact sports players can be particularly serious, leading to neck injuries, concussions and possibly even chronic conditions, protecting contact sports players from repeated hard impacts to the head must be a top priority. However, many existing designs for neck supports for contact sports helmets suffer from a limited ability to absorb hard impacts, and may fail to take into account potential injuries that may occur to the neck of a player due to whiplash.

What is needed is an improved padding and neck support for a contact sports helmet which addresses at least some of the limitations in the prior art.

SUMMARY

The present invention relates to an improved contact sports helmet, for use in various contact sports such as football, hockey and lacrosse, which incorporates an inflatable neck support in order to provide support for a player's neck during an impact.

In an aspect, there is provided a neck support apparatus for a contact sports helmet, comprising: an inflatable neck support comprising at least one air bladder normally in a deflated state, the inflatable neck support adapted to attach to the contact sports helmet; a first air supply; and at least one impact sensor adapted to trigger airflow from the first air supply into the at least one air bladder upon detection of an impact force exceeding a predetermined limit.

In an embodiment, the inflatable neck support is adapted to attach to a base portion of the contact sports helmet normally adjacent to a player's neck when worn, and inflate the at least one air bladder in a manner to deploy the inflatable neck support and help brace the player's neck immediately after an impact. A triggering impact is sensed by one or more impact sensors positioned on the contact sports helmet, and is used to trigger airflow into the at least one air bladder, thus deploying the inflatable neck support in order to help brace a player's neck immediately after a strong impact.

In another embodiment, the inflatable neck support is triggered by one or more resiliently flexible air pockets which are in fluid communication with the inflatable neck support. While the volume of air in the one or more resiliently flexible air pockets may not be sufficient to deploy the inflatable neck support, the amount of air that is moved by compression of one or more of the resiliently flexible air pockets may be used as an alternative means of triggering the inflatable neck support.

In another embodiment, the predetermined amount of force required to trigger inflation of the at least one air bladder is adjustable, such that it is appropriate for the player. For example, the triggering force may be set lower for players who are more susceptible to neck injuries, such as junior players who have not fully developed their neck strength. Senior players or professional players may choose to set the triggering force at a higher level, such that the inflatable neck support is triggered only in the event of high impact.

In another embodiment, the inflatable neck support may include independently inflatable air bladders which are positioned to one side or to the back of the contact sports helmet. In this configuration, each independently inflatable air bladder may be inflated by an impact sensor which is on the opposite side of the air bladder, thus providing a bracing cushion which helps support a player's neck to avoid whiplash on the opposite side of the impact.

In another embodiment, the inflatable neck support is connected to at least one pressurized air supply which is triggered to inflate one or more of the inflatable air bladders upon sensing a triggering force. The pressurized air supply may be positioned in a location of the helmet which is not susceptible to direct impact, and may be placed within a protective housing or compartment built into the contact sports helmet.

In a further embodiment, the pressurized air supply is a $CO_2$ canister sufficiently small and sufficiently light weight to easily store within the contact sports helmet. The canister is replaceable if deployed during an impact, such that the canister always has a sufficient air supply for a subsequent deployment of the inflatable neck support.

In another embodiment, deployment of the inflatable neck support in the helmet is adapted to simultaneously trigger a corresponding deployment of a complementary neck support base which is inflated upwardly from a supporting shoulder pad to engage the inflatable neck support. This complementary neck support base may have its own air supply with one or more compressed air canisters stored in or on the supporting shoulder pad, which one or more canisters may be used to inflate one or more air bladders built into the complementary neck support.

By engaging upwardly to meet the inflatable neck support, the complementary neck support base allows the inflatable neck support to help brace the player's neck sooner. For example, if inflation of the complementary neck support occurs at the same rate as inflation of the inflatable neck support, the bracing could occur within approximately half the time.

In another embodiment, the complementary neck support base includes a deployment sensor which is wirelessly linked to the trigger for the inflatable neck support, whereby both the inflatable neck support and the complementary inflatable neck support base begin inflating at substantially the same time.

In another embodiment, the rate of inflation of the complementary inflatable neck support base may be increased to inflate substantially more quickly than the inflatable neck support, whereby less inflation, or even no inflation in the event of a malfunction, may be needed to provide at least some bracing effect.

In this respect, before explaining at least one embodiment of the invention in detail, it is to be understood that the invention is not limited in its applications to the details of construction and to the arrangements of the components set forth in the following description or the examples provided therein, or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

Figure 1:
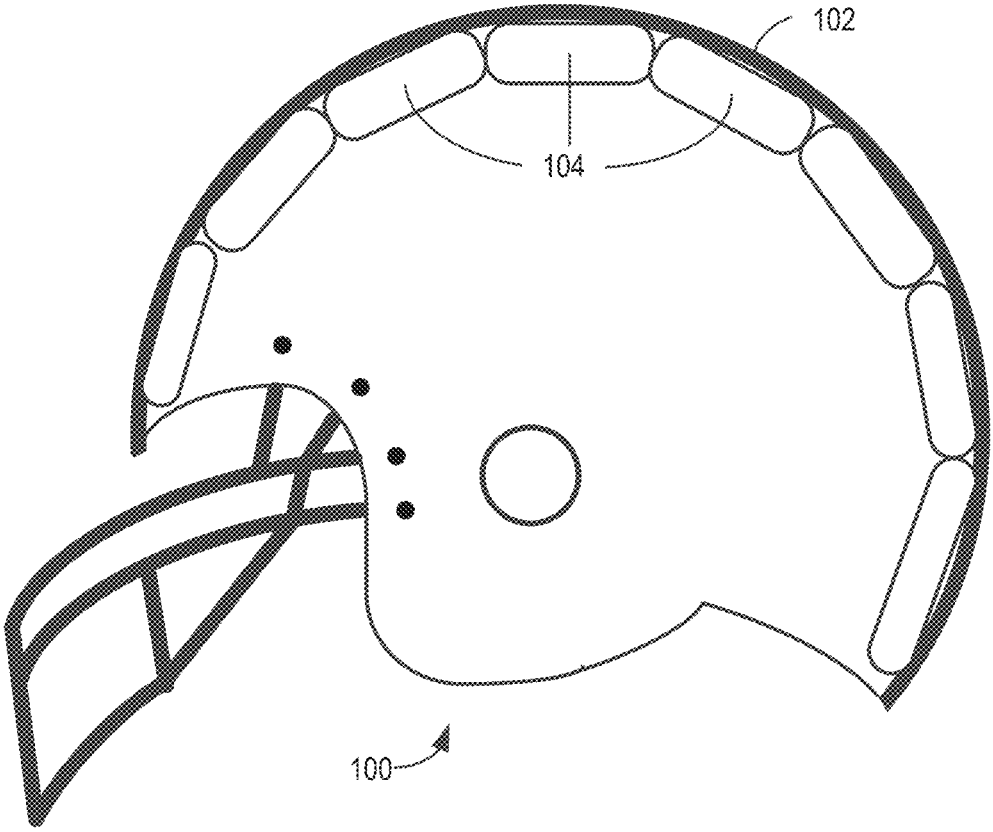
FIG. 1 (Prior Art)
FIG. 1 shows a cross-section of a contact sports helmet, in this example a football helmet, in accordance with the prior art in which a hard plastic shell forms the outer layer, and foam padding is arranged inside in various configurations.

As noted above, the present invention relates to an improved contact sports helmet, for use in various contact sports such as football, hockey and lacrosse, which incorporates an inflatable neck support in order to provide support for a player's neck during an impact.

In an embodiment, the inflatable neck support is attached to a base of the contact sports helmet, and comprises at least one air bladder which is normally in a deflated state. Inflation of the at least one air bladder is triggered by an impact received on the contact sports helmet that is greater than a predetermined amount of force. This triggering impact is sensed by one or more impact sensors positioned on the contact sports helmet, and is used to trigger airflow into the at least one air bladder, thus deploying the inflatable neck support in order to help brace a player's neck immediately after a strong impact.

In another embodiment, the inflatable neck support is triggered by one or more resiliently flexible air pockets which are in fluid communication with the inflatable neck support. While the volume of air in the one or more resiliently flexible air pockets may not be sufficient to deploy the inflatable neck support, the amount of air that is moved by compression of one or more of the resiliently flexible air pockets may be used as an alternative means of triggering the inflatable neck support.

In another embodiment, the predetermined amount of force required to trigger inflation of the at least one air bladder is adjustable, such that it is appropriate for the player. For example, the triggering force may be set lower for players who are more susceptible to neck injuries, such as junior players who have not fully developed their neck strength. Senior players or professional players may choose to set the triggering force at a higher level, such that the inflatable neck support is triggered only in the event of high impact.

In another embodiment, the inflatable neck support may include independently inflatable air bladders which are positioned to one side or to the back of the contact sports helmet. In this configuration, each independently inflatable air bladder may be inflated by an impact sensor which is on the opposite side of the air bladder, thus providing a bracing cushion which helps support a player's neck to avoid whiplash on the opposite side of the impact.

In another embodiment, the inflatable neck support is connected to at least one pressurized air supply which is triggered to inflate one or more of the inflatable air bladders upon sensing a triggering force. The pressurized air supply may be positioned in a location of the helmet which is not susceptible to direct impact, and may be placed within a protective housing or compartment built into the contact sports helmet.

In a further embodiment, the pressurized air supply is a $CO_2$ canister sufficiently small and sufficiently light weight to easily store within the contact sports helmet. The canister is replaceable if deployed during an impact, such that the canister always has a sufficient air supply for a subsequent deployment of the inflatable neck support.

In another embodiment, deployment of the inflatable neck support in the helmet is adapted to simultaneously trigger a corresponding deployment of a complementary neck support base which is inflated upwardly from a supporting shoulder pad to engage the inflatable neck support. This complementary neck support base may have its own air supply with one or more compressed air canisters stored in or on the supporting shoulder pad, which one or more canisters may be used to inflate one or more air bladders built into the complementary neck support.

By engaging upwardly to meet the inflatable neck support, the complementary neck support base allows the inflatable neck support to help brace the player's neck sooner. For example, if inflation of the complementary neck support occurs at the same rate as inflation of the inflatable neck support, the bracing could occur within approximately half the time.

In another embodiment, the complementary neck support base includes a deployment sensor which is wirelessly linked to the trigger for the inflatable neck support, whereby both the inflatable neck support and the complementary inflatable neck support base begin inflating at substantially the same time.

In another embodiment, the rate of inflation of the complementary inflatable neck support base may be increased to inflate substantially more quickly than the inflatable neck support, whereby less inflation, or even no inflation in the event of a malfunction, may be needed to provide at least some bracing effect.

As illustrated in FIG. 1, shown is a cross-section of a contact sports helmet 100, in this example a football helmet, in accordance with the prior art in which a hard plastic shell 102 forms the outer layer, and foam padding 104 is arranged inside in various configurations. This conventional football helmet design can transfer a significant amount of impact force to the head of a football player, as there is a lack of impact absorption material that will collapse or compress sufficiently to absorb an impact.

Figure 2:
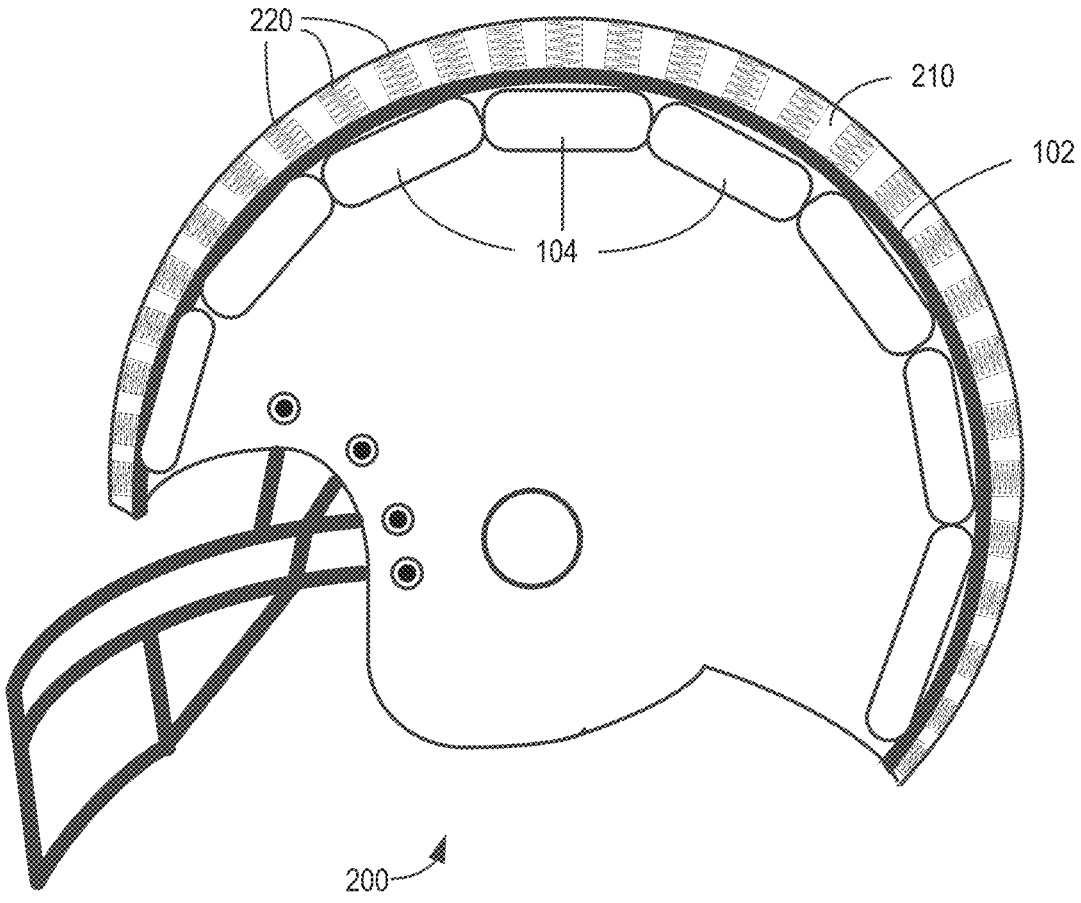
FIG. 2 shows a cross-section of a contact sports helmet, in this example a football helmet, in accordance with an embodiment in which a layer of impact absorption padding is formed outside of the hard plastic shell of FIG. 1.

FIG. 2 shows a cross-section of a contact sports helmet 200, in this example a football helmet, in accordance with an embodiment of the present invention, in which a layer of padding 210 is formed outside of the hard plastic shell 102 of FIG. 1. In an embodiment, the impact absorption padding incorporates a plurality of air pockets 220 formed from a resiliently flexible material, such as plastic or rubber. At least some of the air pockets 220 enclose a resiliently flexible impact absorption member, such as a coil or spring. The resiliently flexible impact absorption member is resiliently flexible over a wide range of temperatures, and oriented to compress in the direction of impact to absorb a substantial amount of the energy of an impact. The resiliently flexible impact absorption member is also sized and shaped to return the air pocket in which it is housed to a desired thickness and shape after an impact.

Figure 3:
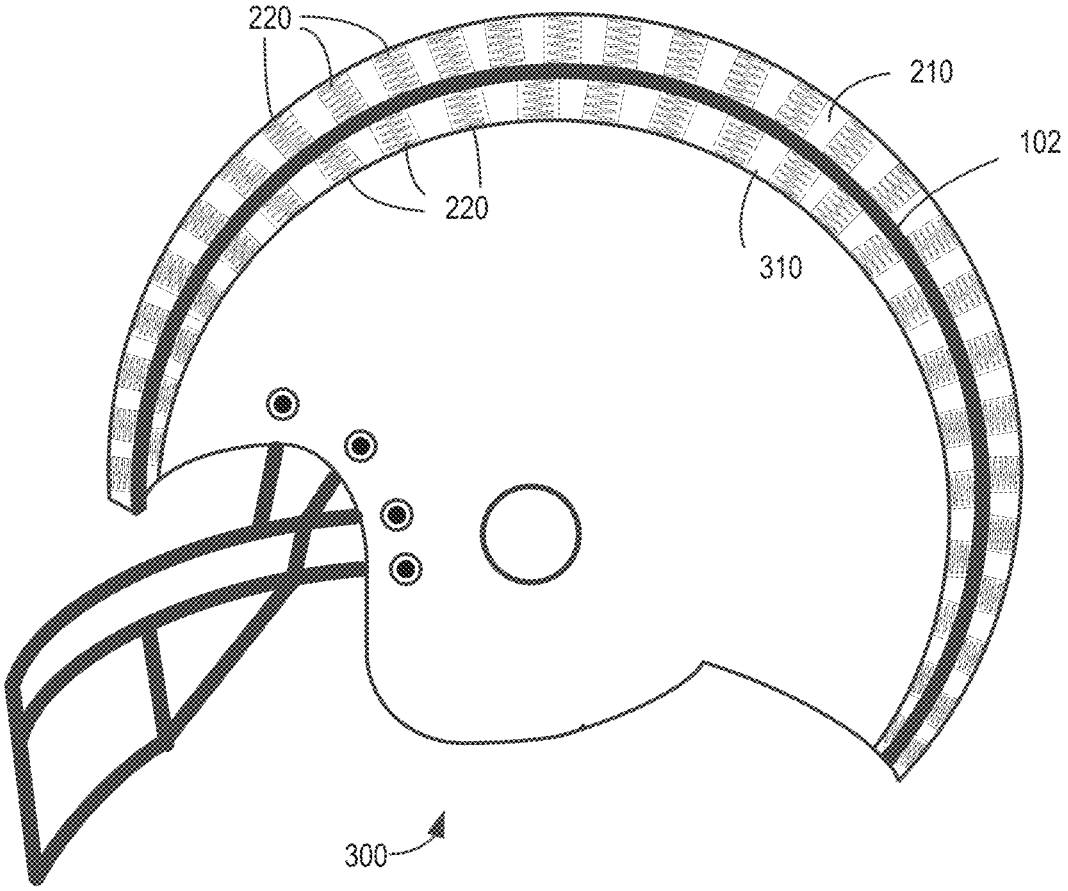
FIG. 3 shows a cross-section of a contact sports helmet, in this example a football helmet, in accordance with another embodiment in which a layer of impact absorption padding is formed both outside of the hard plastic shell, and inside of the hard plastic shell.

FIG. 3 shows a cross-section of a contact sports helmet 300, in this example a football helmet, in accordance with another embodiment in which layers of impact absorption padding 210, 310 are formed both outside of the hard plastic shell 102, and inside of the hard plastic shell. This second inner layer 310 of impact absorption padding may be securely attached to the inside of the football helmet shell 102 to replace any conventional padding material. Similar to the outer layer of impact absorption padding 210, the inner layer of impact absorption padding 310 may also be formed from an array or grid of air pockets 220, at least some or all of which may include a resiliently flexible impact absorption member, such as a coil or spring. These air pockets 220 may be sized and shaped to comfortably surround the head of a football player. Thin foam pads (not shown) may be used to line the air pockets for additional comfort and to fill in any gaps. Some through holes may be placed in between air pockets to allow for adequate ventilation in warm conditions.

Figure 4:
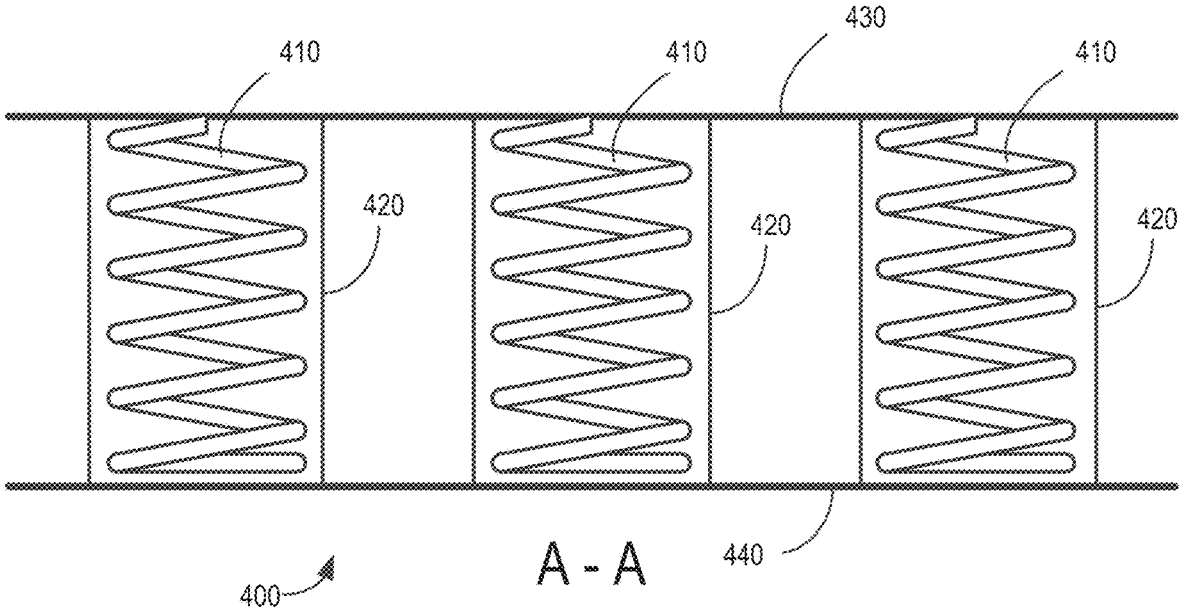
FIG. 4 shows a partial cross-sectional view of a layer of padding in accordance with an embodiment, in which a number of individual coils or springs are encased within an air pocket or cell.

FIG. 4 shows a partial cross-sectional view of a layer of padding 400 in accordance with an embodiment, in which a number of individual coils or springs 410 are encased within an air pocket or cell 420. The air pockets 420 may be formed from various thicknesses of plastic and rubber forming different parts of the air pocket. For example, the top layer 430 forming the outer surface may be relatively thick, to provide some structure and strength to the array or grid. The walls between adjacent air pockets 420 may be formed of a thinner, more flexible material, allowing each air pocket to expand more easily into adjacent air pockets if compressed by an impact force.

Figure 5:
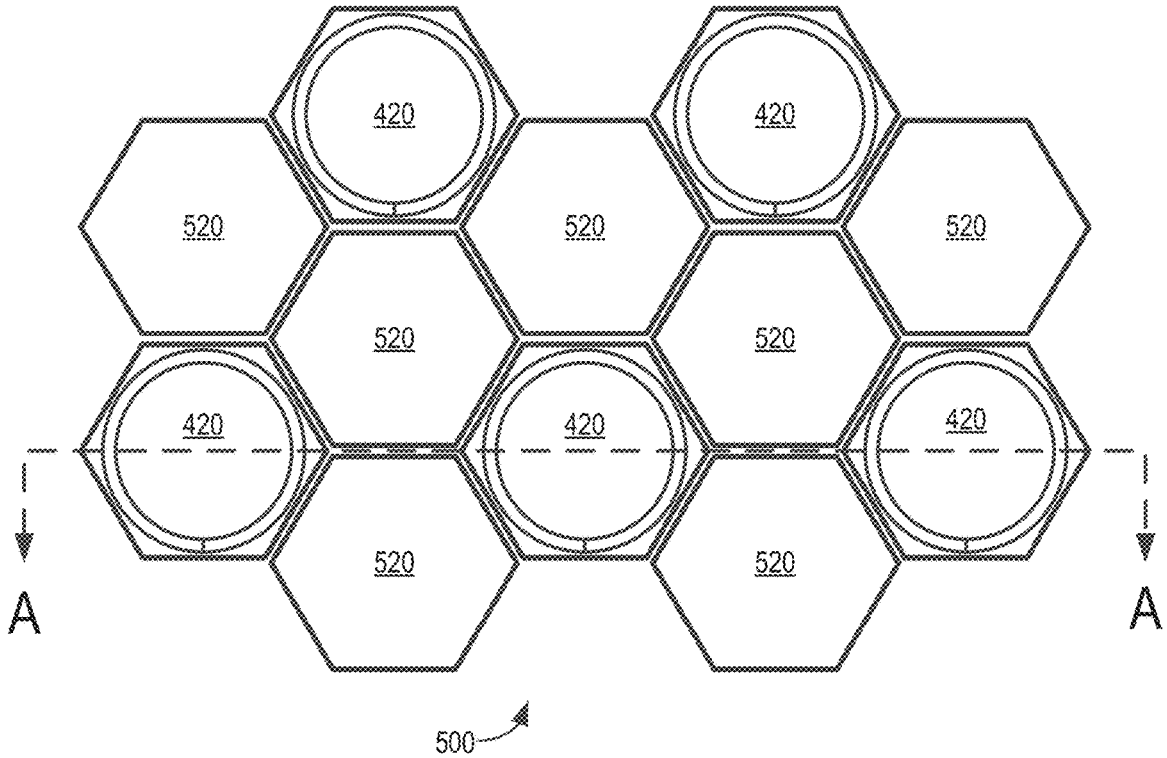
FIG. 5 shows a schematic view of an arrangement of air pockets in accordance with an illustrative embodiment, some of which air pockets include individual coils or springs.

FIG. 5 shows a schematic view of an arrangement 500 of air pockets 420, 520 in accordance with an illustrative embodiment, some of which air pockets 420 include resiliently flexible impact absorption member, such as individual coils or springs. Other air pockets 520 may not include such individual coils or springs. As shown in FIG. 5, the air pockets 420, 520 are arranged in an array or grid, bonded to a base layer 440 of harder plastic. The base layer 440 may be a molded plastic layer adapted to the shape of a contact sports helmet shell. The resiliently flexible impact absorption members are provided in different patterns in at least some of the air pockets 420, or all of them. This impact absorption layer 400 of air pockets 420, 520 may be arranged to substantially cover the outside of a football helmet shell 102, and attached to the helmet shell 102 using secure, removable fasteners.

Figure 6:
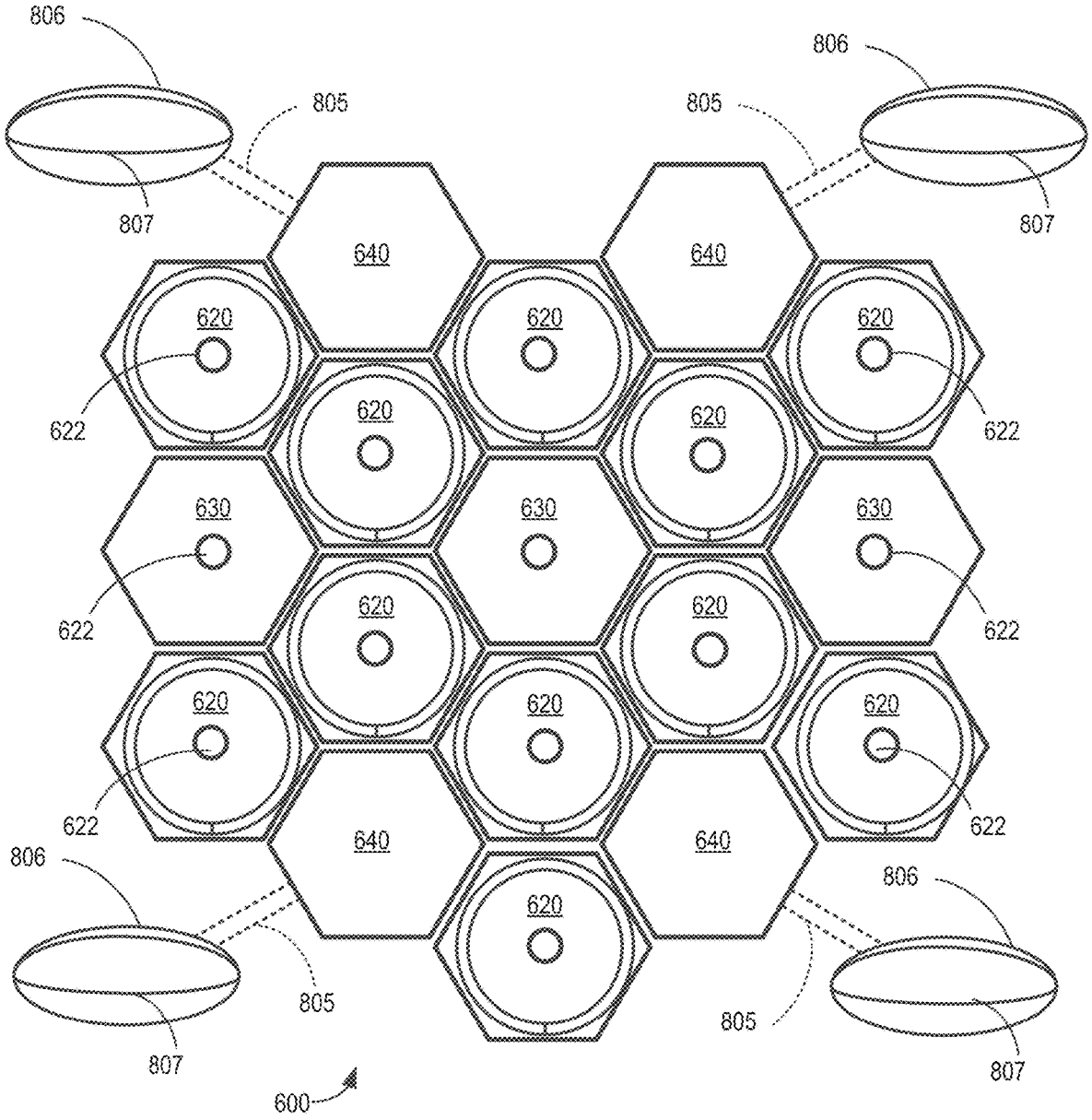
FIG. 6 shows another schematic view of an arrangement of air pockets, some of which air pockets include individual coils or springs.

As shown in FIG. 6, in an embodiment 600, some air pockets 620 may include a pressure control valve 622 which allows air to escape from the air pocket at a controlled rate. The controlled rate is set to allow the air pocket 620 to absorb impacts without deflating too quickly. After compression, the resiliently flexible impact absorption member (i.e. coil or spring) returns the air pocket 620 to its original position.

Adjacent air pockets 630 that do not contain resiliently flexible impact absorption members (i.e. coils or springs) may also include a pressure control valve 622 which allows air to escape at a different rate from the air pockets 620 containing a resiliently flexible impact absorption member (i.e. coil or spring), thereby providing at least two different adjacent air pockets 620, 630 with different impact absorption characteristics. The pressure control valves 622 also allow air back into the air pocket 620 when the coil or spring restores the air pocket 620 to its original shape and volume.

Advantageously, a severe impact to the contact sports helmet can be substantially absorbed by the impact absorption layer 210, 310, 400, 500, 600, before most of the energy is transferred to the contact sports player's head.

Still referring to FIG. 6, some of the air pockets 640 that do not contain springs or coils may be completely sealed without pressure control valves, such that such air pockets 640 contain a relatively constant amount of air at all times. However, as the air pockets 640 are formed from a resiliently flexible material, the volume of air may be at least partially displaced into adjacent air pockets 620 including springs or coils.

Still referring to FIG. 6, in another embodiment, the air pockets 640 that do not contain springs or coils and do not contain pressure control valves may include small air tubes 805 that run to inflatable bladders 806 located on the opposite side of the contact sports helmet 200. These bladders 806, normally deflated, may be positioned at the base of the helmet 200 where the helmet would touch the shoulder pads. As the air pockets 640 would not have any other air escape points, they would send their air to the normally deflated bladder 806 located directly on the opposite of side of the helmet 200 (see FIG. 11B below) where the hit was initiated, thereby decreasing/softening the whiplash effect of a heavy hit.

In an embodiment, the bladder 806 is resiliently flexible such that it is adapted to return to a deflated position after the impact. As an example, the bladder 806 may include flexible ribs 807 which force the bladder 806 to return to a deflated position, unless there is air pushed into it from a hit. These bladders 806 do not need to be very large, and may be approximately the same size as an air pocket 640, such that the volume of air from the air pocket 640 is sufficient to inflate the bladder 806 upon impact. Typically, as there would be a plurality of bladders 806 which would inflate directly opposite the location of the hit, the plurality of bladders 806 would collectively soften the hit and help avoid potential damage to the neck or brain.

In an embodiment, each bladder 806 may be shaped to maximize their impact absorption capability, for example as elongated tubes or "fingers" that provide enough cushion to prevent neck damage. These bladders 806 could also be used in conjunction with other inflatable cushioning means, as described further below.

Figure 7:
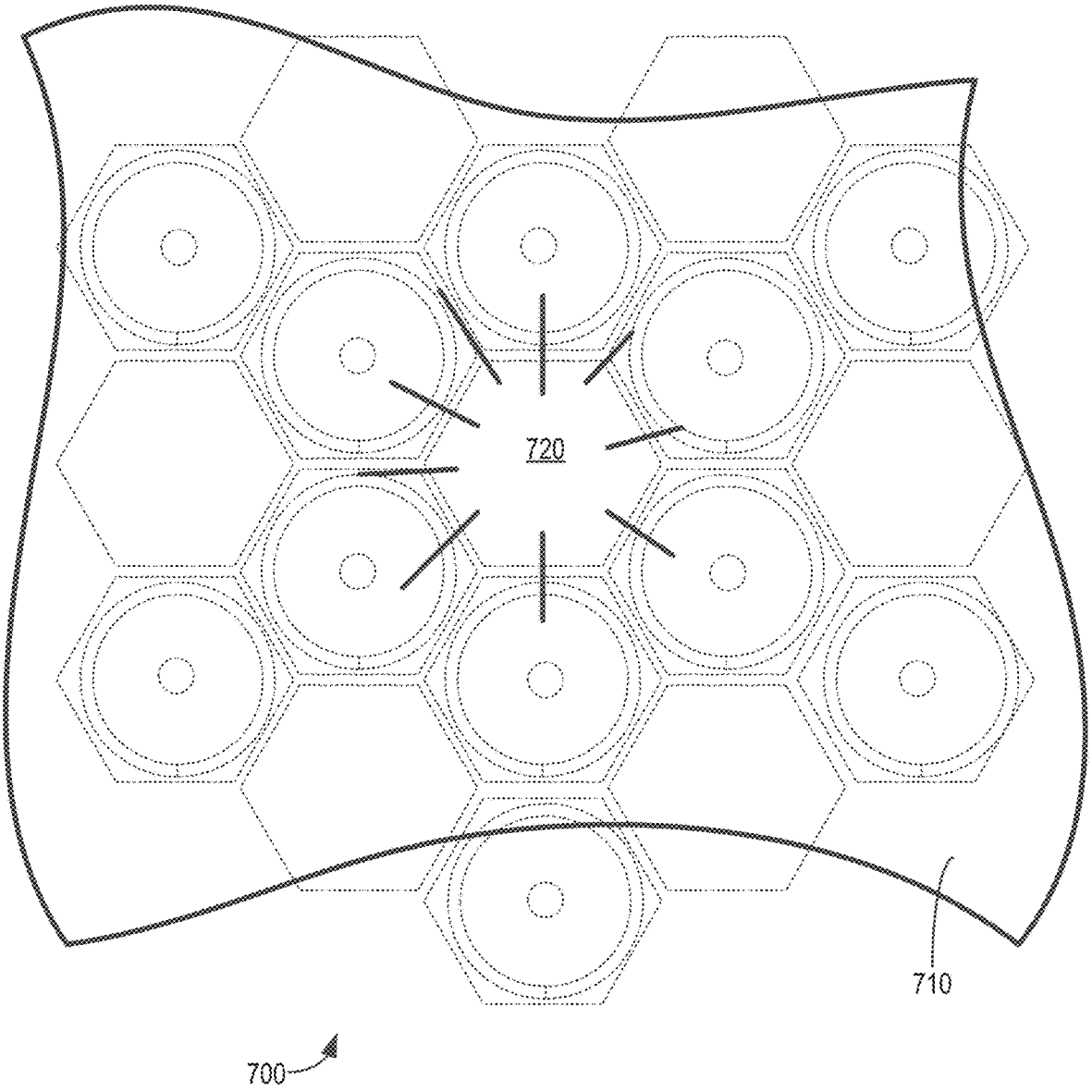
FIG. 7 shows another schematic view of an optional outer skin adapted to be non-resilient when the impact force exceeds a certain predetermined threshold.

FIG. 7 shows another schematic view 700 of an optional outer skin 710 adapted to be non-resilient when the impact force exceeds a certain predetermined threshold. This outer skin 710 may be adapted to show the extent and severity of an impact to the helmet which has exceed a threshold, by visual markings at the area of impact 720, such as by a deformation of the outer skin indicated by depressions and other visual cues. This allows the player or team doctor to test the player for possible concussion, and depending on severity, put the player into concussion protocol. This marking 720 of a severe impact on the outer skin 710 can also provide a cue to replace the outer layer of impact absorption padding 210, 400, 500, 600.

In an embodiment, this outer skin 710 may be a silicone-like skin that is firmly bonded to the top of the layer of air pockets 620, 630, 640. This outer layer 710 may receive paints or decals depicting team colors and logos on the football helmet.

Figure 8:
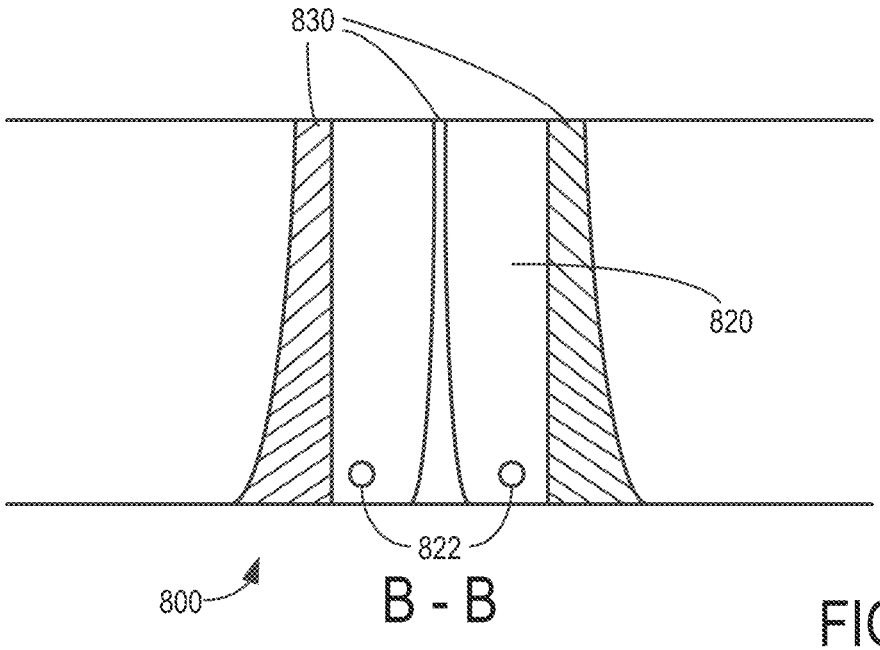
FIG. 8 shows a cross-sectional view of a layer of padding in accordance with another embodiment, in which each air pocket or cell includes a plurality of ribs positioned around the air pocket or cell.
Figure 9:
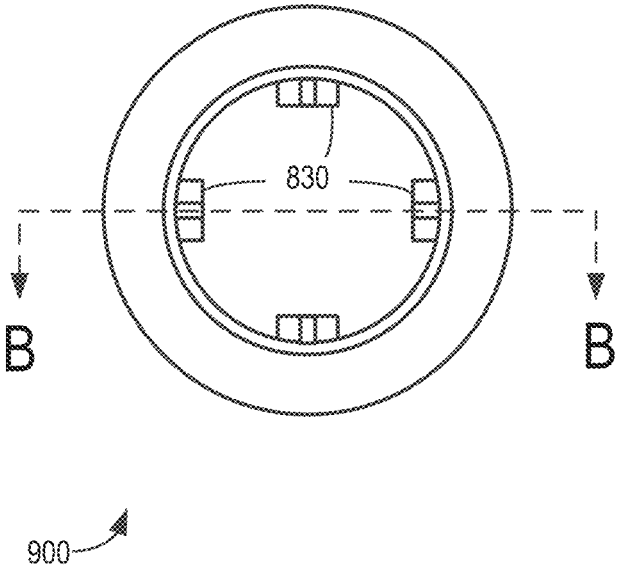
FIG. 9 shows a corresponding top view of the embodiment of FIG. 8.

Now referring to FIG. 8, shown is a cross-sectional view of a layer of padding 800 in accordance with another embodiment, in which each air pocket or cell 820 includes a plurality of resiliently flexible ribs 830 positioned around the wall of air pocket or cell. FIG. 9 shows a corresponding top view 900 of the embodiment of FIG. 8. In this embodiment, the plurality of ribs 830 are generally vertically oriented, and are shaped so as to provide a progressively increasing cross-section or thickness from the top of the ribs 830 to the bottom (see FIG. 8). This progressively increasing cross-section allows the air pocket 820 of FIGS. 8 and 9 to compress in the direction of impact to absorb a progressively increasing impact force. The amount of impact force that the ribs 820 can absorb may be varied by the number of ribs 830 spaced around the air pocket or cell 820, and the cross-section of the ribs 830 as they progressively increase from top to bottom.

In an embodiment, the plurality of ribs 830 in the embodiment of FIGS. 8 and 9 are of a resiliently flexible plastic or rubber material, and are adapted to return to their original shape after absorbing an impact force.

In another embodiment, the air pocket or cell 820 of FIGS. 8 and 9 is provided with pressure control valve 822 adapted to control the rate at which air escapes from an air pocket 820. In this embodiment, the pressure control valve 822 is adapted to allow air to escape to either an adjacent air pocket, an inflatable bladder, or ambient air.

Figure 10:
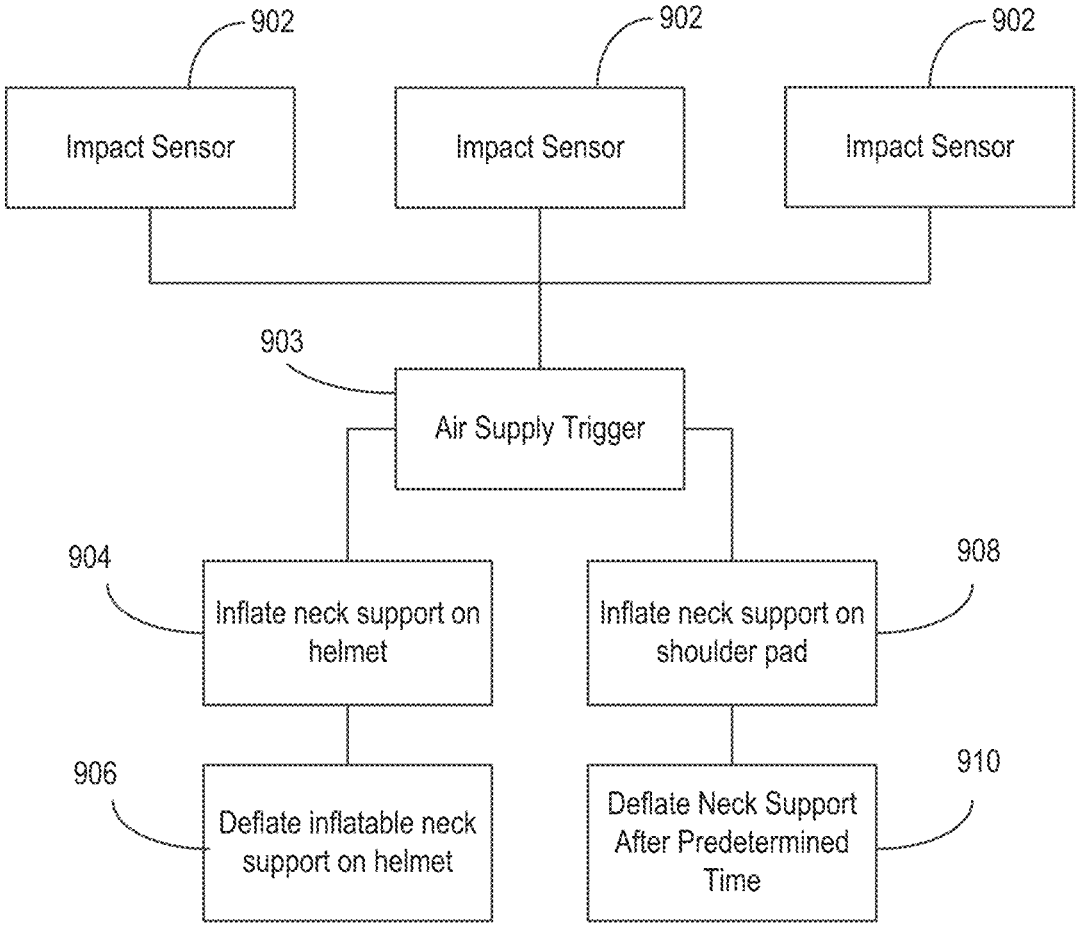
FIG. 10 shows an illustrative system for sensing and activating an inflatable neck support in accordance with an illustrative embodiment.

Now referring to FIG. 10, shown is an illustrative system for sensing and activating an inflatable neck support in accordance with an illustrative embodiment. As shown, the system includes one or more impact sensors 902 adapted to sense an impact force exceeding a predetermined level, in order to trigger inflation of an inflatable neck support 1102, as shown in FIGS. 11A and 11B.

Figure 11A:
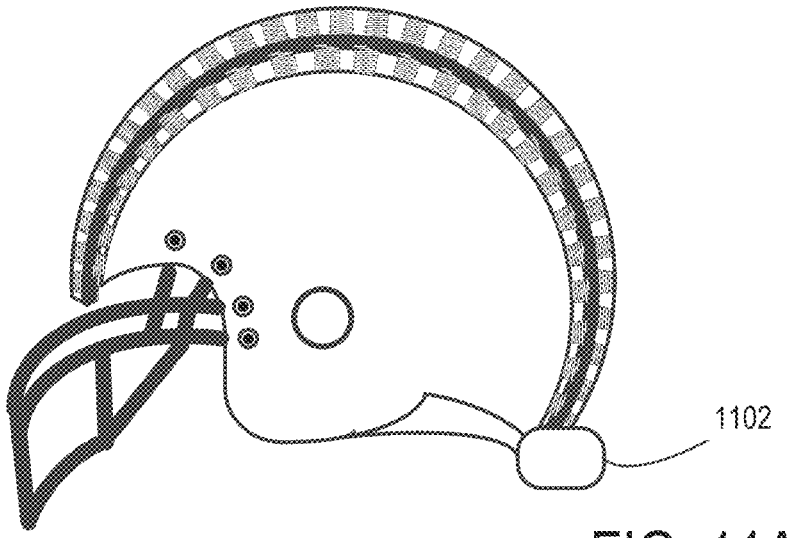
FIGS. 11A and 11B show an illustrative example of an inflatable neck support before and after inflation.
Figure 11B:
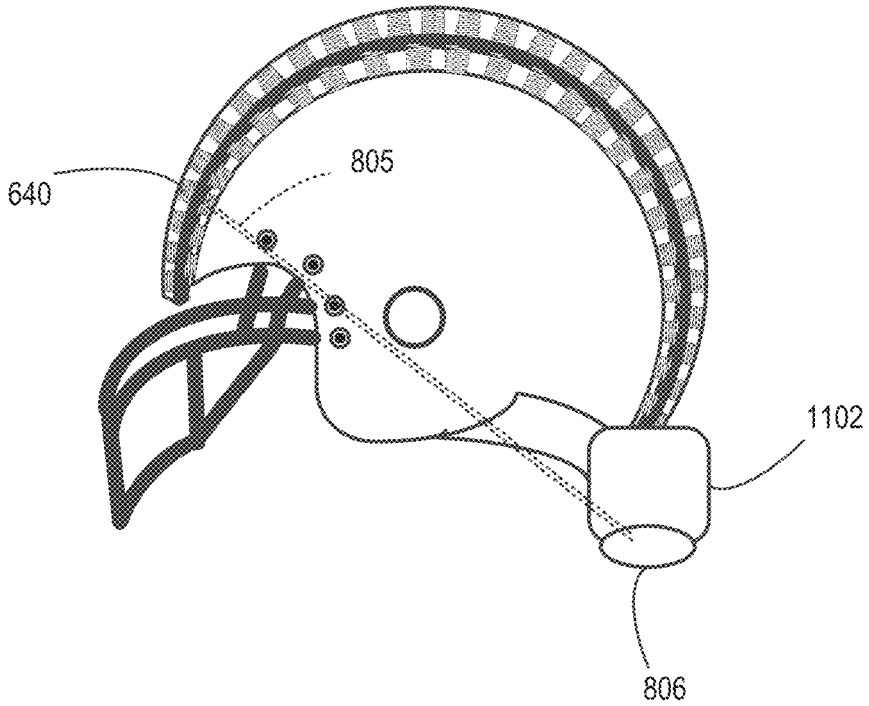
Figure 12A:
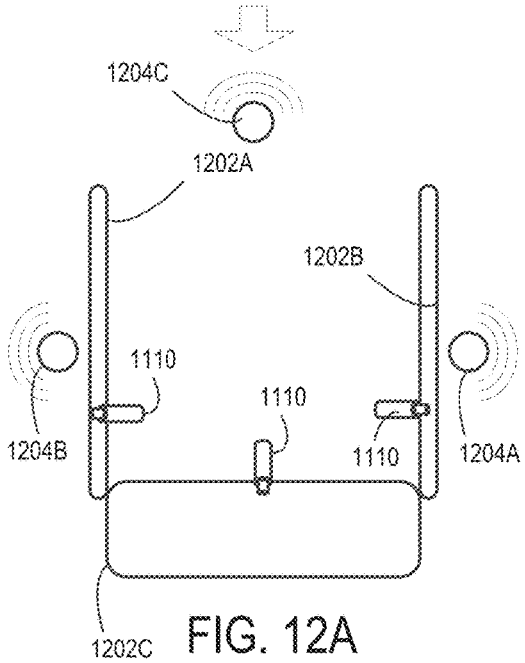
FIGS. 12A-12D show a schematic example of different air bladders of an inflatable neck support being inflated depending on the direction of an impact force, in accordance with an illustrative embodiment.
Figure 12B:
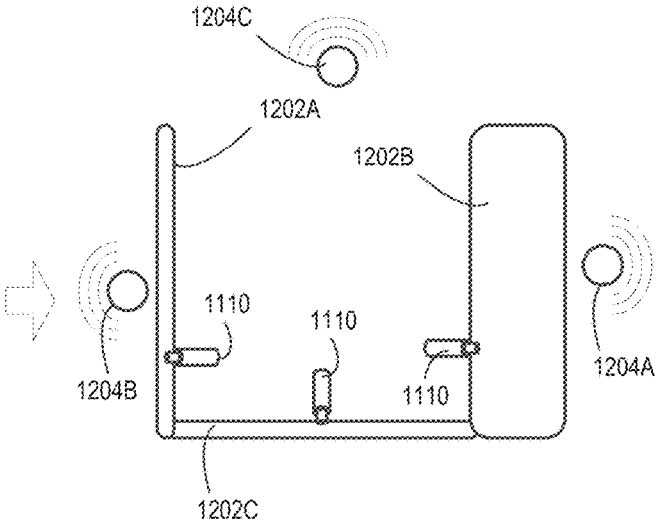
Figure 12C:
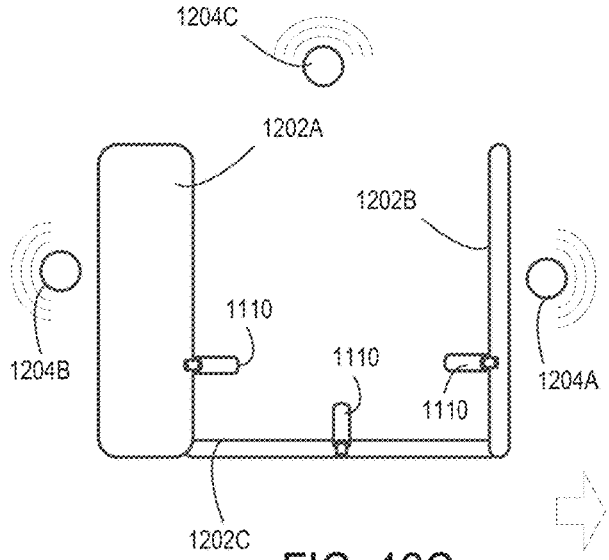
Figure 12D:
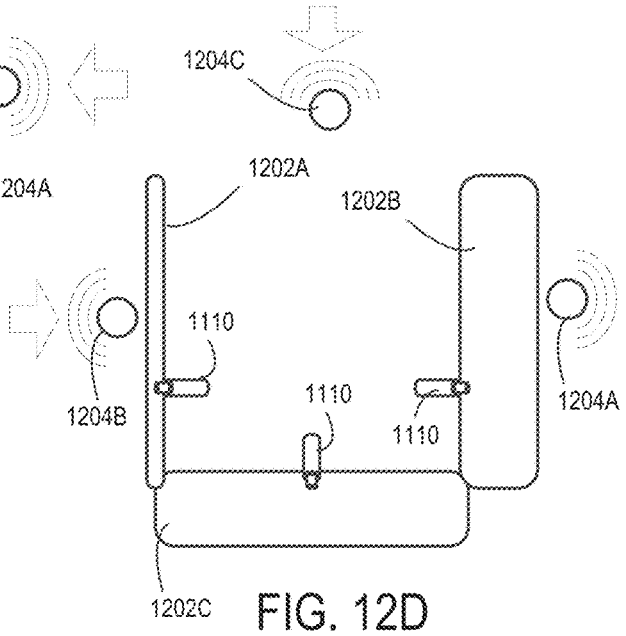

In an embodiment, as shown in FIG. 11A, the inflatable neck support 1102 comprises at least one air bladder which is normally in a deflated state. Inflation of the at least one air bladder is triggered by an impact received on the contact sports helmet 200 that is greater than a predetermined amount of force. This triggering impact is sensed by one or more impact sensors positioned on the contact sports helmet 200, and is used to trigger airflow into the at least one air bladder, thus deploying the inflatable neck support 1102 as shown in FIG. 11B, in order to help brace a player's neck immediately after a strong impact.

In an embodiment, a plurality of impact sensors 902 may be built into the contact sports helmet 200 and positioned around the contact sports helmet 200 to sense an impact from various directions. Preferably, the predetermined amount of impact force required to trigger inflation of the inflatable neck support 1102 is adjustable, such that it is appropriate for each player. For example, the triggering force may be set lower for players who are more susceptible to neck injuries, such as junior players who have not fully developed their neck strength. Senior players or professional players may choose to set the triggering force at a higher level, such that the inflatable neck support is triggered only in the event of a very high impact force with a greater risk of causing a neck injury.

In another embodiment, the inflatable neck support 1102 is triggered by one or more resiliently flexible air pockets which are in fluid communication with the inflatable neck support 1102. While the volume of air in the one or more resiliently flexible air pockets may not be sufficient to deploy the inflatable neck support, the amount of air that is moved by compression of one or more of the resiliently flexible air pockets may be used as an alternative means of triggering the inflatable neck support.

FIGS. 11A and 11B show an illustrative example of an inflatable neck support 1102 before and after inflation. While this illustrative example shows the inflatable neck support 1102 expanding outwardly and partially from the base of the contact sports helmet 200, it will be appreciated that repositioning the inflatable neck support 1102 may allow the expansion to occur more downwardly, if desired.

In another embodiment, the inflatable neck support is connected to at least one pressurized air supply which is triggered to inflate one or more of the inflatable air bladders upon sensing a triggering force. The pressurized air supply may be positioned in a location of the helmet which is not susceptible to direct impact, and may be placed within a protective housing or compartment built into the contact sports helmet.

In order to rapidly inflate an air bladder in the event of a high impact force, a pressurized air supply may be used. For example, the pressurized air supply may be a self-contained $CO_2$ canister sufficiently small and sufficiently light weight to be easily stored within the contact sports helmet 200. The canister is replaceable if deployed during an impact, such that the canister always has a sufficient air supply for a subsequent deployment of the inflatable neck support 1102, as may be necessary. The canister may also be housed in a quick access compartment, such that the canister is easily and quickly replaceable. The canister may also be provided with a valve allowing the canister to be recharged after being fired. This would ensure that the canister could be refilled on the sidelines, so that it may be used again within a game. Alternatively, a supply of fully charged canisters may be kept on hand, in order to minimize the time required to replace a fired canister.

In another embodiment, as shown in FIGS. 12A-12D, the inflatable neck support may comprise independently inflatable air bladders 1202A-1202C which are positioned to each side or to the back of the contact sports helmet. In this configuration, each independently inflatable air bladder 1202A-1202C may be inflated in dependence upon a corresponding impact sensor 1204A-1204C which is located on the impact sports helmet 200 on the opposite side of the air bladder 1202A-1202C, thus providing a bracing cushion opposite an impact force (represented by an arrow) which helps support a player's neck to avoid whiplash on the opposite side of the impact force.

Still referring to FIGS. 12A-12D, in another embodiment, the inflatable neck support may comprise independently inflatable air bladders 1202A-1202C which contain air canisters 1110 adapted to be triggered by the corresponding impact sensor 1204A-1204C. The impact sensor 1204A-1204C may be calibrated to detect an impending impact force, and upon detecting an impact force that exceeds a predetermined G-force threshold, the impact sensor 1204A-1204C can electrically or wirelessly trigger one or more air canisters 1110 to inflate one or more appropriate air bladders 1202A-1202C. These impact sensors 1204A-1204C may be calibrated to a different G-force threshold depending on the age of the player—to be more sensitive for younger players who are children, and less sensitive for older players who are adolescents or adults.

In another embodiment, the impact sensors 1204A-1204C may be calibrated to inflate the inflatable air bladders 1202A-1202C proportionately in accordance with the severity of the detected impact force. Therefore an anticipated smaller hit would partially inflate one or more air bladders 1202A-1202C, or larger hits may inflate the one or more air bladders 1202A-1202C faster or more fully.

These inflatable air bladders 1202A-1202C and corresponding air canisters 1110 may be configured as swappable modules which may be swapped by trainers or coaches on the sidelines, and will only go off when sufficient G-forces are sensed in the helmet. The helmet 200 may be provided with brackets or sockets to receive the modules and plug into appropriate electrical or wireless connections to be operatively connected to the corresponding impact sensors 1204A-1204C.

In another embodiment, additional sensors provided on helmet 200 or somewhere else on the player's body may be utilized to trigger inflation of the inflatable neck support 1102, including collision sensors provided on other parts of a player's padding or on their clothing. Such other sensors may be used to sense speed and momentum interruption, and may also sense the direction of an imminent impact to allow a player to brace for impact with the inflatable neck support engaged opposite the imminent impact.

Figure 13A:
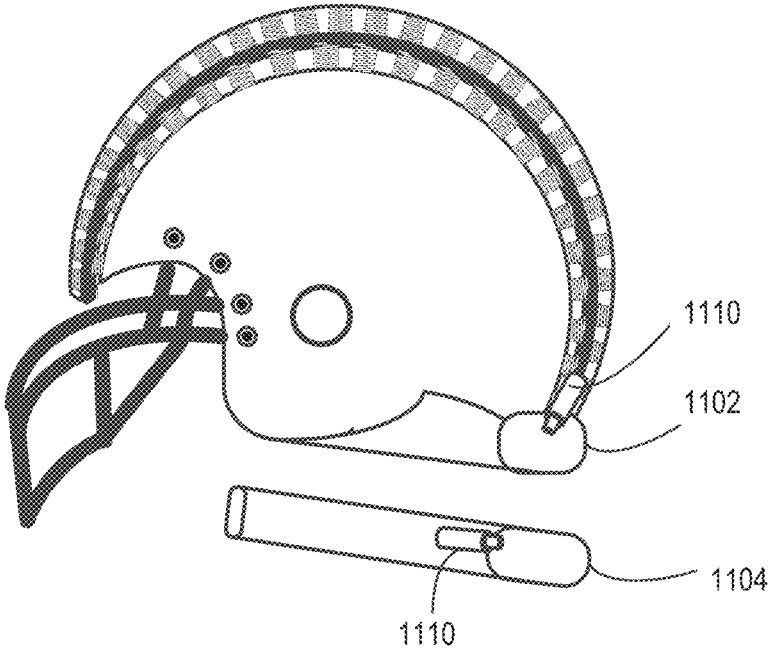
FIGS. 13A and 13B show an example of a complementary inflatable neck support base in accordance with an illustrative embodiment.
Figure 13B:
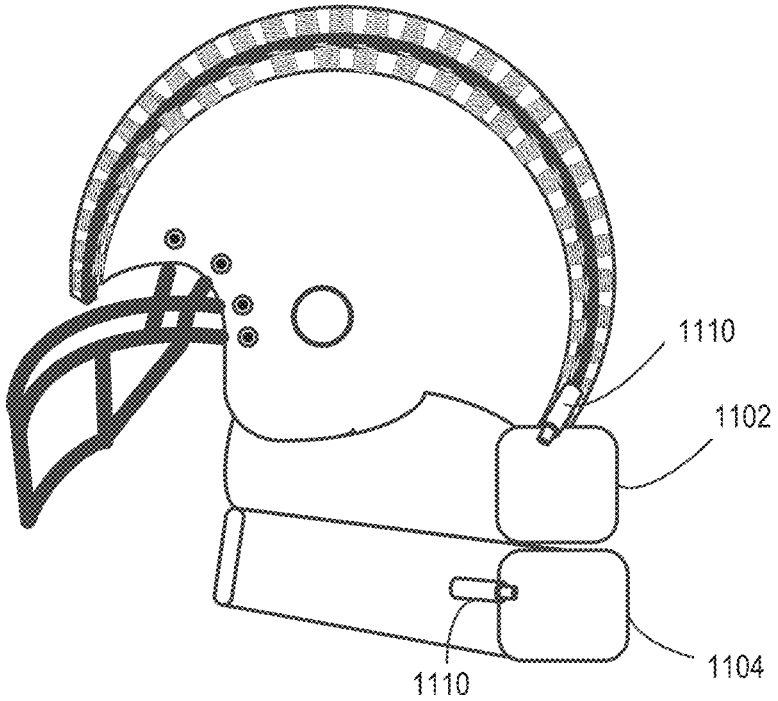

Now referring to FIGS. 13A and 13B, shown is an example of a complementary inflatable neck support base 1104 in accordance with an illustrative embodiment.

Preferably, deployment of the inflatable neck support 1102 will simultaneously trigger a corresponding deployment of a complementary neck support base 1104, which is inflated upwardly from a supporting shoulder pad to engage the inflatable neck support 1102. This complementary neck support base may have its own air supply with one or more compressed air canisters 1110 stored in or on the supporting shoulder pad, which one or more canisters 1110 may be used to inflate one or more air bladders built into the complementary neck support.

By engaging upwardly to meet the inflatable neck support, the complementary neck support base allows the inflatable neck support to help brace the player's neck sooner. For example, if inflation of the complementary neck support occurs at the same rapid rate as inflation of the inflatable neck support, the bracing could occur within approximately half the time.

In another embodiment, the complementary neck support base includes a deployment sensor which is wirelessly linked to the trigger for the inflatable neck support, whereby both the inflatable neck support and the complementary inflatable neck support base begin inflating at substantially the same time.

In another embodiment, the rate of inflation of the complementary inflatable neck support base may be increased to inflate substantially more quickly than the inflatable neck support, whereby less inflation, or even no inflation in the event of a malfunction, may be needed to provide at least some bracing effect.

Thus, in an aspect, there is provided a neck support apparatus for a contact sports helmet, comprising: an inflatable neck support comprising at least one air bladder normally in a deflated state, the inflatable neck support adapted to attach to the contact sports helmet; a first air supply; and at least one impact sensor adapted to trigger airflow from the first air supply into the at least one air bladder upon detection of an impact force exceeding a predetermined limit.

In an embodiment, the inflatable neck support is adapted to attach to a base portion of the contact sports helmet normally adjacent to a player's neck when worn, and inflate the at least one air bladder in a manner to deploy the inflatable neck support and help brace the player's neck immediately after an impact.

In another embodiment, the predetermined limit for the impact force sufficient to trigger airflow is adjustable.

In another embodiment, a plurality of impact sensors are positioned on the contact sports helmet at locations likely to first receive an impact force.

In another embodiment, the impact sensor is in fluid communication with at least one resiliently flexible air pocket, whereby a sufficient amount of air pressure received from the at least one resiliently flexible air pocket triggers deployment of the inflatable neck support.

In another embodiment, the inflatable neck support includes a plurality of independently inflatable air bladders.

In another embodiment, the independently inflatable air bladders are positioned at least to each side and to the back of the contact sports helmet.

In another embodiment, airflow into an independently inflatable air bladder is triggered by a corresponding impact sensor positioned on an opposite side of the contact sports helmet.

In another embodiment, airflow into an independently inflatable air bladder is triggered by a corresponding resiliently flexible air pocket located on the opposite side of the contact sports helmet.

In another embodiment, the air supply is a pressurized air supply in a canister.

In another embodiment, the pressurized air supply in the canister is adapted to be fired upon receiving a trigger signal from the at least one impact sensor.

In another embodiment, the pressurized air supply in the canister is $CO_2$.

In another embodiment, the pressurized air supply in a canister is replaceable.

In another embodiment, the pressurized air supply in a canister is adapted to be stored in a compartment built into the contact sports helmet.

In another embodiment, the apparatus further comprises a complementary neck support base comprising at least one air bladder normally in a deflated state, the complementary neck support base adapted to attach to a shoulder pad; a second air supply; and an airflow trigger for the complementary neck support base responsive to a signal received from the at least one impact sensor to trigger airflow from the second air supply into the at least one air bladder in the neck support base upon detection of an impact force exceeding the predetermined limit.

In another embodiment, the airflow trigger for the complementary neck support base is wirelessly linked to the at least one impact sensor adapted to trigger airflow from the first air supply into the at least one air bladder of the inflatable neck support.

In another embodiment, the apparatus further comprises a plurality of supplemental air bladders, each supplemental air bladder connected via an air tube to an air pocket lining the contact sports helmet, whereby one or more of the supplemental air bladders are inflated by corresponding one or more air pockets which collapse upon impact.

In another embodiment, each supplemental air bladder is positioned generally on the opposite side of the location of the air pocket on the helmet, so as to inflate on the opposite side of the impact force.

In another embodiment, each supplemental air bladder is shaped to maximize impact absorption.

In another embodiment, each supplemental air bladder is resiliently flexible, and adapted to return to a deflated state after an impact force is removed from the corresponding air pocket.

While illustrative embodiments have been described above by way of example with respect to a football helmet, it will be appreciated that the impact absorption padding as described above may be applied to other contact sports helmets, such as hockey helmets and lacrosse helmets, for example. Any contact sport in which players repeatedly come into hard contact and wear helmets for head protection may benefit from the impact absorption padding as described above.

Various changes and modifications may be made without departing from the scope of the invention, which is defined by the following claims.

The invention claimed is:

1. A neck support apparatus for a contact sports helmet, comprising:

an inflatable neck support comprising at least one air bladder normally in a deflated state, the inflatable neck support adapted to attach to the contact sports helmet;

at least one air pocket to be positioned on the contact sports helmet, each air pocket shaped to collapse upon receiving an impact force exceeding a predetermined limit; and at least one air tube connecting the at least one air pocket to the at least one air bladder to transfer a volume of air contained in the at least one air pocket to the at least one bladder to inflate the at least one air bladder upon collapse of the at least one air pocket.

2. The apparatus of claim 1, wherein the inflatable neck support is adapted to attach to a base portion of the contact sports helmet normally adjacent to a player's neck when worn, and inflate the at least one air bladder in a manner to deploy the inflatable neck support and help brace the player's neck immediately after an impact.

3. The apparatus of claim 2, wherein the predetermined limit for the impact force is adjustable.

4. A neck support apparatus for a contact sports helmet, comprising:

an inflatable neck support comprising at least one air bladder normally in a deflated state, the inflatable neck support adapted to attach to the contact sports helmet;

a first air supply; and at least one impact sensor adapted to trigger airflow from the first air supply into the at least one air bladder upon detection of an impact force exceeding a predetermined limit, wherein the impact sensor is in fluid communication with at least one resiliently flexible air pocket, whereby a sufficient amount of air pressure received from the at least one resiliently flexible air pocket triggers deployment of the inflatable neck support.

5. The apparatus of claim 4, wherein a plurality of impact sensors are positioned on the contact sports helmet at locations likely to first receive an impact force.

6. The apparatus of claim 2, wherein the inflatable neck support includes a plurality of independently inflatable air bladders.

7. The apparatus of claim 6, wherein the independently inflatable air bladders are positioned at least to each side and to the back of the contact sports helmet.

8. The apparatus of claim 4, wherein the inflatable neck support includes a plurality of independently inflatable air bladders, wherein the plurality of independently inflatable air bladders are positioned at least to each side and to the back of the contact sports helmet, and wherein airflow into an independently inflatable air bladder is triggered by a corresponding impact sensor positioned on an opposite side of the contact sports helmet.

9. The apparatus of claim 7, wherein an independently inflatable air bladder is inflated by collapse of a corresponding air pocket located on the opposite side of the contact sports helmet.

10. The apparatus of claim 4, wherein the air supply is a pressurized air supply in a canister.

11. The apparatus of claim 10, wherein the pressurized air supply in the canister is adapted to be fired upon receiving a trigger signal from the at least one impact sensor.

12. The apparatus of claim 10, wherein the pressurized air supply in the canister is C02.

13. The apparatus of claim 10, wherein the pressurized air supply in a canister is replaceable.

14. The apparatus of claim 10, wherein the pressurized air supply in a canister is adapted to be stored in a compartment built into the contact sports helmet.

15. The apparatus of claim 4, further comprising a complementary neck support base comprising at least one air bladder normally in a deflated state, the complementary neck support base adapted to attach to a shoulder pad;

a second air supply; and an airflow trigger for the complementary neck support base responsive to a signal received from the at least one impact sensor to trigger airflow from the second air supply into the at least one air bladder in the neck support base upon detection of an impact force exceeding the predetermined limit.

16. The apparatus of claim 15, wherein the airflow trigger for the complementary neck support base is wirelessly linked to the at least one impact sensor adapted to trigger airflow from the first air supply into the at least one air bladder of the inflatable neck support.

17. The apparatus of claim 4, further comprising a plurality of supplemental air bladders, each supplemental air bladder connected via an air tube to an air packet lining the contact sports helmet, whereby one or more of the supplemental air bladders are inflated by corresponding one or more air pockets which collapse upon impact.

18. The apparatus of claim 17, wherein each supplemental air bladder is positioned generally on the opposite side of the location of the air pocket on the helmet, so as to inflate on the opposite side of the impact force.

19. The apparatus of claim 18, wherein each supplemental air bladder is shaped to maximize impact absorption.

20. The apparatus of claim 17, wherein each supplemental air bladder is resiliently flexible, and adapted to return to a deflated state after an impact force is removed from the corresponding air pocket.

* * * * *